United States Patent [19]

Hankison

[11] Patent Number: 4,641,994

[45] Date of Patent: Feb. 10, 1987

[54] PARKING GUIDE

[76] Inventor: Paul M. Hankison, 106 Oakwood Rd., McMurray, Pa. 15137

[21] Appl. No.: 694,586

[22] Filed: Jan. 24, 1985

[51] Int. Cl.[4] ..... E01F 13/00

[52] U.S. Cl. ..... 404/6; 188/32

[58] Field of Search ..... 404/6, 7, 9; 188/32; 414/229

[56] References Cited

U.S. PATENT DOCUMENTS

| | | | |
|---|---|---|---|
| 1,776,935 | 9/1930 | Snyder | 188/32 X |
| 1,780,277 | 11/1930 | Seeley et al. | 188/32 X |
| 2,655,225 | 10/1953 | Harris | 404/7 X |
| 3,024,871 | 3/1962 | Stein | 188/32 |
| 3,065,680 | 11/1962 | Wiedman | 404/6 X |
| 3,347,343 | 10/1967 | Lockhart | 188/32 |
| 3,590,959 | 7/1971 | Ferketich | 188/32 |
| 4,490,085 | 12/1984 | Adami née Michelini | 414/229 |

*Primary Examiner*—Stephen J. Novosad
*Assistant Examiner*—Matthew Smith
*Attorney, Agent, or Firm*—Webb, Burden, Robinson & Webb

[57] ABSTRACT

The present invention is a parking guide 10 having first and second chocks 12 and 14, linearly interconnected by a spacing rod 32, positioned adjacent and parallel to a garage wall by first and second extension rods 16 and 18. The chocks 12 and 14 are painted with white and safety orange paint or other highly visible coating. To park his car, the driver aims for the highly visible chocks 12 and 14 and proceeds into the garage until the first and second automobile wheels 36 and 38 contact the inclined surface of the chocks 12 and 14; the slight resistance of the chocks, when encountered by the wheels, signals the driver to stop. The parking guide is lightweight and portable, may be assembled without tools, and may be used in any parking facility.

9 Claims, 4 Drawing Figures

PARKING GUIDE

INTRODUCTION

Parking an automobile in a garage may be a simple task, but simplicity alone does not alleviate the irritation and risk of minor property damage that many drivers encounter every day. As everyone knows, the car must be properly positioned in the garage to allow access to the hood and trunk, to permit clearance for all doors, and to leave the necessary passage room on all sides. If the garage includes work and storage areas, proper placement of the automobile becomes even more important (and commensurately more difficult). In multi-car garages, particularly those which serve more than one family, careful positioning of the car is a requisite to minimize damage from passersby, children's wheel-mounted toys, adjacent car doors, etc.

FIELD OF THE INVENTION

The present invention relates generally to parking devices and specifically to a parking guide which facilitates parking a car in a garage; the parking guide provides both a high visibility target for the driver as he aims his automobile and an adjustable contact surface for signaling to the driver that his car is parked in the proper position.

DESCRIPTION OF THE PRIOR ART

Various parking devices are known in the art, such as the frame guide mounted on a garage wall as disclosed in U.S. Pat. No. 3,347,343 to Lockhart. Other parking devices designed for use in the garage are the chock devices disclosed in U.S. Pat. Nos. 2,956,646 and 3,024,871 to Isgren et al. and Stein, respectively. A metallic parking guide formed from a length of steel tubing is disclosed in U.S. Pat. No. 3,209,662 to Morton, and a device for marking parking limits on a street curb is revealed in U.S. Pat. No. 1,479,651 to Clements.

These prior art arrangements do facilitate the parking operation, but each involves bulky or immoveable sections, nonadaptable configurations designed for an automobile of particular dimensions, and unnecessarily high cost resulting from unnecessary structural components. A need remains for a lightweight, fully adjustable inexpensive parking guide to assist a driver in parking his or her car in the garage.

In order to meet this need, the present invention provides a parking guide which is portable and lightweight for easy installation in a single or multi-car garage. The parking guide is highly visible and provides a convenient target toward which the driver may aim his automobile; the invention further provides a signal to the driver when the car has arrived in the desired position. The device is fully adjustable to accommodate automobiles of varying dimensions, yet unnecessary structural components (and their associated costs) have been eliminated. The device may be assembled, adjusted, installed or removed by hand, without tools.

SUMMARY OF THE INVENTION

The parking guide 10 provides a first and second chock 12 and 14, linearly interconnected by a spacing rod 32, positioned adjacent and parallel to a garage wall 42 (or another solid boundary such as a curb) by first and second extension rods 16 and 18. The chocks 12 and 14 have a highly visible paint or coating. To park his car, the driver aims for the highly visible chocks 12 and 14 and proceeds into the garage until the first and second automobile wheels 36 and 38 contact the inclined surface of the chocks 12 and 14; the slight resistance of the chocks, when encountered by the wheels, signals the driver to stop. The parking guide may be assembled without tools and may be used in any commercial or domestic garage or parking facility. The casters 28 and 30 prevent the device from scratching or damaging the garage wall.

BRIEF DESCRIPTION OF THE DRAWINGS

The invention will be more fully described in conjunction with the accompanying drawings in which.

DETAILED DESCRIPTION OF THE INVENTION

Figure 1:
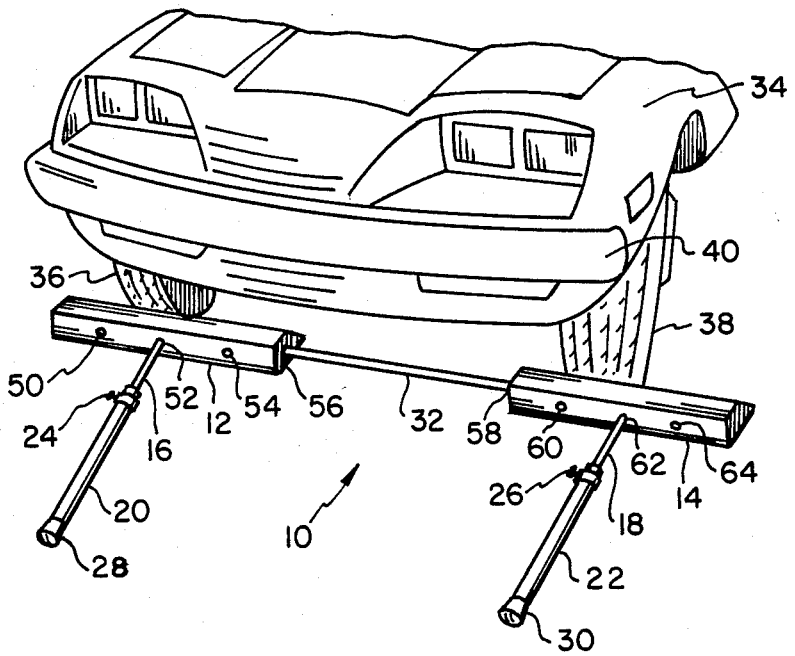
FIG. 1 is a perspective view of the front portion of an automobile, the wheels of which are in contact with the present invention.

Referring now to the drawings and initially to FIG. 1, the automobile 34 is parked adjacent to the parking guide 10. The first and second automobile wheels 36 and 38 are adjacent to and in contact with the inclined surface of each of the first and second chocks 12 and 14. The chocks are relatively positioned by the spacing rod 32 which connects them, and by the first and second extension rods 16 and 18 extending therefrom.

Figure 3:
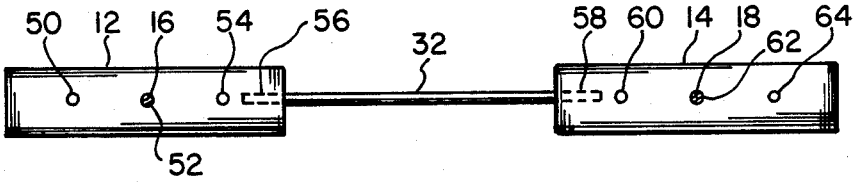
FIG. 3 is a sectional view of the present parking guide, taken along line III—III of FIG. 2.

More specifically, the first and second chocks 12 and 14 each has four apertures therein. As shown in FIG. 3, the first chock 12 includes the first, second, third and fourth tubular insets 50, 52, 54, and 56, and the second chock 14 includes the fifth, sixth, seventh and eighth tubular insets 58, 60, 62 and 64. The spacing rod 32 linearly interconnects the first and second chocks 12 and 14, one end of the rod being disposed within tubular inset 56 and the other end of the rod being disposed within tubular inset 58.

Figure 4:
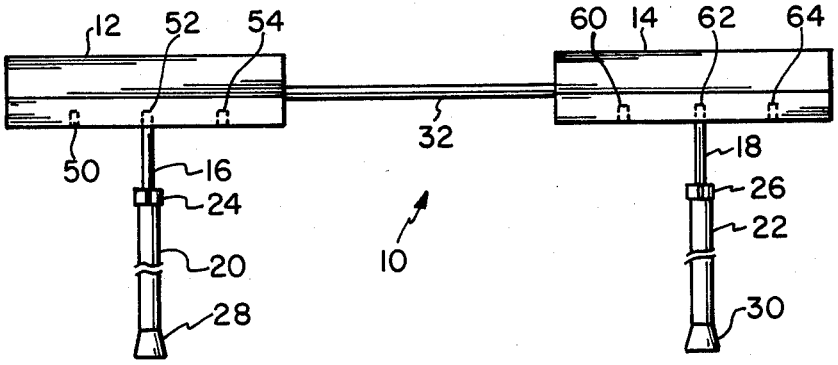
FIG. 4 is a plan view of the present parking guide as assembled for use with an automobile of average track.

As shown in FIG. 4, one end of each of the first and second extension rods 16 and 18 is disposed within the second and seventh tubular insets 52 and 62, respectively. The opposite end of each of the first and second extension rods 16 and 18 is axially disposed within the first and second extension rod housings 20 and 22, respectively. More particularly, the first extension rod 16 is adjustably axially disposed within the first extension rod housing 20 by means of the first thumbscrew 24. The terminus of the first extension rod housing 20 is disposed within the first caster 28. Likewise, the second extension rod 18 is adjustably axially disposed within the second extension rod housing 22 by means of the second thumbscrew 26, and the terminus of the second extension rod housing 22 is disposed within the second caster 30. The first and second thumbscrews 24 and 26 are ordinary set screw arrangements well known to those of ordinary skill in the art.

OPERATION

Figure 2:
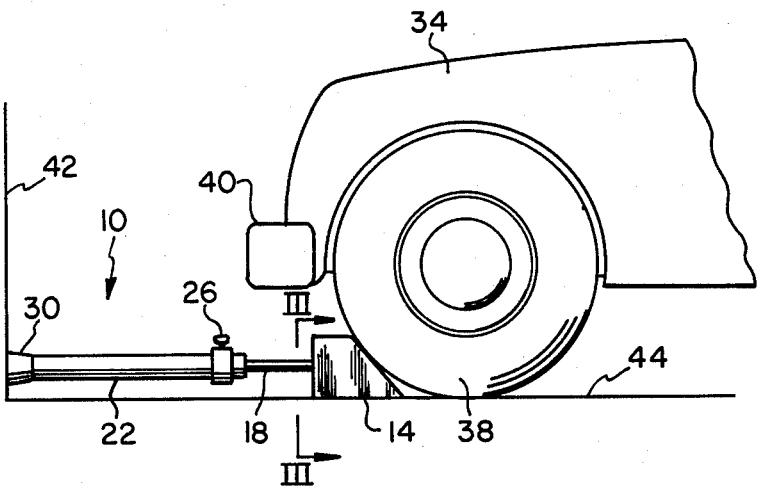
FIG. 2 is a side elevational view of an automobile wheel in contact with a chock of the present parking guide, the automobile being in the proper position relative to the garage wall.

Referring now to FIG. 2, the second chock 14 is held in position relative to the garage wall 42 by the adjusted assembly of the second extension rod, extension rod housing, thumbscrew and caster 18, 22, 26 and 30. As the automobile 34 approaches the parking guide 10, it translates unimpeded until the wheel 38 contacts the inclined surface of the chock 14, thus encountering resistance which the driver can interpret as a signal to stop the car. In addition to the resistance, the front portion of the automobile 34 will rise as the wheel traverses the inclined surface of the chock 14, and the rising motion can serve as an additional signal to stop the car.

Referring now to FIG. 1, after the wheels 36 and 38 encounter the chocks 12 and 14, the parking brake of the automobile 34 may be engaged immediately, or the driver may permit the wheels 36 and 38 to roll in reverse to clear the chocks 12 and 14 before setting the parking brake or putting the car in parking gear.

Referring again to FIG. 2, the second caster 30 absorbs shock between the parking guide 10 and the garage wall 42. Minimal shock is generating during use, however, because the inclined surface of the chock 14 is preferably 45° or less from the horizontal. The relatively shallow inclined surface, therefore, provides a plane onto which the wheel 38 may readily roll, preventing the wheel from pushing against the chock in such a way as the slide the parking guide 10 across the garage floor 44. (An optional nonslip surface on the underside of each chock, such as a rubber, plastic or polymer coating, may also prevent shock to the garage wall 42 by further minimizing sliding of the parking guide 10 during use.) The caster 30 may remain suspended above the garage floor 44 due to the forces of friction generated by the chock 14, the optional nonslip coating and the caster 30, or the caster 30 may rest against both the wall 42 and the floor 44 due to natural tensile elasticity in the coupling of the extension rod and the second tubular inset.

The parking guide 10 is assembled as follows: the first chock 12 is placed on end with the fourth tubular inset 56 on top. One end of spacing rod 32 is inserted into the fourth tubular inset 56 and secured by manual tapping. The second chock 14 is likewise set on end and the other end of spacing rod 32 is likewise tapped into the fifth tubular inset. First extension rod 16 is similarly inserted in one of the first, second or third tubular insets 50, 52 or 54 (for automobiles of wide, average, and narrow track, respectively) and the second extension rod 18 is inserted into the corresponding sixth, seventh or eighth tubular insets 60, 62 or 64 to result in a parking guide 10 that is symmetrical in assembly. The first and second extension rod housings 20 and 22 are slid over the extension rods 16 and 18, the assembly is placed on the garage floor and the extension rods are adjusted to accommodate a particular automobile and garage. The assembly is then tightened with thumbscrews 24 and 26.

The chocks 12 and 14 may be fabricated of aluminum, steel or other metal sheet material; they may also be constructed of fiberglass, high strength polymer sheets or wood panels. The chocks may be hollow or solid; if solid, they may be fashioned of cast metals or plastics or carved from wood blocks or boards. Each chock 12 and 14, if hollow, may be left open at each end opposite the fourth and fifth tubular insets 56 and 58, respectively. A nonslip surface may be bonded to or incorporated into the lower surface of the chocks 12 and 14, such a surface including rubber, plastic or polymer sheets or a nonslip pattern or grooves. Each of the chocks 12 and 14 has an inclined surface which measures from about 5° to about 60° from the horizontal. Each chock measures from 2 to 25 inches in length, from 2 to 10 inches in width and from 1 to 6 inches in height. The tubular insets 50, 52, 54, 56, 58, 60, 62 and 64 range from ⅛ to 1 inch in diameter and from 0.5 to 4.5 inches in length.

The extension rods 16 and 18 and the spacing rod 32 may be solid or hollow, and may be of aluminum, steel, other suitable metal or alloy, wood or thermoset or thermoplastic polymer. The extension rod housings 20 and 22 may be made of steel or aluminum or other suitable metal sheet, and the thumbscrews 24 and 26 may likewise be fashioned of any suitable material. The casters 28 and 30 may be rubber or plastic. The extension rods 16 and 18 measure from 0.5 to 2.5 inches in diameter and from 5 to 50 inches in length. The extension rod housings 20 and 22 measure from 0.6 to 3.0 inches in diameter and from 5 to 45 inches in length. The spacing rod 32 measures from ⅛ to 1 inch in diameter and from 20 to 80 inches in length.

In the preferred embodiment of the invention, the chocks 12 and 14 are fashioned of solid pin wood and apertures are bored therein; each chock measures 20 inches in length, 3.25 inches in width, 1.5 inches in height and has an inclined surface which measures 45° from the horizontal. Each aperture is a tubular inset having a length of 1.5 inches and a diameter of 0.5 inches. The first, second, third, sixth, seventh and eighth tubular insets 50, 52, 54, 60, 62 and 64 are evenly spaced along the length of the chocks, 5 inches apart. The exterior surfaces of the chocks 12 and 14 are coated with patterns of a paint or coating material, preferably having high visibility and more preferably having patterns of white and safety orange.

The chocks 12 and 14 are linearly interconnected by the spacing rod 32, the spacing rod 32 measuring 48 inches in length and 0.5 inches in diameter. As a result, the interconnected chocks measure 85 inches in span after assembly (allowing for the coupling at each end of spacing bar 32). Accordingly, the distance between the first and eighth tubular insets 50 and 64 measures 75 inches, thus accommodating an automobile of 75 inches, or wide, track. ("Track" is the distance between the two front wheels 36 and 38.) Likewise, the distance between the second and seventh tubular insets 52 and 62 measures 65 inches and the distance between the third and sixth tubular insets 54 and 60 measures 55 inches, respectively, accommodating automobiles of average and narrow track. (The extension rods 16 and 18 may also be fitted in the first and seventh tubular insets 50 and 62 to accommodate a car of 70 inch track, or may be fitted into the second and fifth tubular insets 52 and 58 to accommodate a car of 60 inch track.)

The extension rods 16 and 18 of the preferred embodiment of the invention are each 0.5 inches in diameter and 30 inches in length. The extension rod housings 20 and 22 are 1 inch in diameter and 25 inches in length. The casters 28 and 30 are made of thermoplastic material and measure 1.5 inches in diameter at the base. All elements of the preferred embodiment of the invention, except the chocks and casters, are fabricated of aluminum and the preferred embodiment of the parking guide accordingly weighs less than 25 pounds, completely assembled.

Various changes may be made in the shape, size and construction of the components without departing from the spirit or scope of the invention. For example, the chocks 12 and 14 may be fashioned of any material, composite or laminate having a strength-to-weight ratio that permits the invention to be portable as well as durable and useful. the inclined surface of each chock may be somewhat concave or convex instead of straight. The parking guide may be used adjacent to a wall, curb or any partition or boundary having a mathematic vertical component. These and other adaptations of the present invention will be readily apparent to those skilled in the art in light of the above teachings, and although the invention has been described with reference to specific materials under specific conditions, the invention is to be limited only insofar as is to set forth in the accompanying claims.

I claim:

1. A parking guide for positioning a vehicle having at least two wheels thereon a predetermined distance from a boundary, comprising:

first and second incline means each having a first surface abutting a spacing means, a second surface abutting one of two extension means, and an inclined surface thereon, said first surface having an inset therein and said second surface having a plurality of insets therein;

wherein said spacing means connects said first and second incline means at a predetermined distance in a line; and wherein said two extension means is a first and second extension means attached to said first and second incline means and extending generally horizontally and generally perpendicularly from said line formed by said incline means and said spacing means, said extension means being adapted to abut against a solid boundary whereby said incline means are positioned a predetermined distance from said boundary.

2. A parking guide as in claim 1 wherein each of said first and second extension means is an extension rod adjustably mounted within an extension rod housing.

3. A parking guide as in claim 1 wherein each of said first and second extension means is an extension rod adjustably mounted within an extension rod housing by means of a thumbscrew.

4. A parking guide as in claim 3 wherein said extension rod has a caster at its end which abuts the boundary.

5. A parking guide as in claim 1 wherein each of said first and second incline means has a highly visible coating thereon.

6. A parking guide as in claim 1 wherein each of said first and second incline means has white and safety orange paint thereon.

7. A parking guide as in claim 1 wherein each of said first and second incline means is a wood block having at least three apertures therein.

8. A parking guide as in claim 1 wherein each of said first and second incline means is a wood block having an inclined surface thereon and four apertures therein.

9. A parking guide as in claim 1 wherein said second surface has three insets therein which are spaced evenly apart, and wherein each of said inclined surfaces has white and safety orange paint thereon.

* * * * *